United States Patent [19]

Kalen

[11] 4,004,898

[45] Jan. 25, 1977

[54] CYCLONE SEPARATOR GAS TUBE HEAT DISSIPATOR

[75] Inventor: Bodo Kalen, Dix Hills, N.Y.

[73] Assignee: Emtrol Corporation, Great Neck, N.Y.

[22] Filed: Jan. 30, 1976

[21] Appl. No.: 653,617

[52] U.S. Cl. ..... 55/267; 55/435; 55/459 R

[51] Int. Cl.[2] ..... B04C 3/02

[58] Field of Search ..... 55/267, 435, 459 R, 55/459 A, 459 B, 459 C, 459 D; 209/144; 210/512 R

[56] References Cited

UNITED STATES PATENTS

| | | | |
|---|---|---|---|
| 1,844,369 | 2/1932 | Ross | 55/459 R |
| 2,162,550 | 6/1939 | Frankford | 55/267 |
| 2,187,646 | 1/1940 | Darrieus | 55/459 D |
| 2,524,703 | 10/1950 | Hartman | 55/267 |
| 2,796,147 | 6/1957 | Coanda | 55/459 R |
| 3,273,320 | 9/1966 | Delaune et al. | 55/267 |

FOREIGN PATENTS OR APPLICATIONS

| | | | |
|---|---|---|---|
| 260,776 | 11/1926 | United Kingdom | 55/459 R |

*Primary Examiner*—Frank W. Lutter
*Assistant Examiner*—David L. Lacey
*Attorney, Agent, or Firm*—Glenn K. Robbins

[57] ABSTRACT

A cyclone separator having heat dissipating and structural re-inforcing means. The cyclone separator has a gas outlet tube passing through the top of the separator shell and extending into the cyclone body. In order to prevent high temperature build-up the connection of the outlet gas tube with the shell is specially designed in order that heat contact be with only one side of the outlet gas tube wall. The gas outlet tube has a lower portion extending into the top portion of the separator shell and is connected to an inverted frusto-conical upwardly diverging wall. This wall is also connected to the top wall of the cyclone separator. This structure provides an annular space to dissipate heat from high temperature gases which would otherwise in conventional structures contact both sides of the wall of the gas outlet tube and break down or liquify the metallic structure. Radial heat transfer fins are preferably employed within the annular space connecting the exterior gas outlet tube to the diverging wall and the top of the cyclone separator for additional heat transfer and dissipation to the outside atmosphere and also as a strenghtening means. The interior walls are insulated with conventional ceramic or refractory material to minimize heat losses.

9 Claims, 3 Drawing Figures

CYCLONE SEPARATOR GAS TUBE HEAT DISSIPATOR

BACKGROUND OF THE INVENTION

In the past there has been a problem in providing cyclone dust separation equipment for use in various types of industrial processes which operate at extremely high temperatures as example in the range 1500° F to 3000° F and even higher temperatures. Such equipment must be designed to continuously withstand such temperatures or sudden surges of extremely high temperature gases and not fail. Various processes employed in industries require cyclone separators which utilize extremely high temperatures, for example coal gasification, incineration, fuel combustion and calcining.

Cyclone separators to operate effectively require a gas discharge tube or vortex finder. This gas discharge tube is located centrally within the cyclone separator and extends into the housing below the top of the separator in the conventional design of the cyclones. Thus both sides of the gas discharge or outlet tube, both exterior and the interior walls, are exposed to the extremely high temperature condition. The remainder of the cyclones can be thermally insulated internally so that commercially available steel materials can be utilized for the shell of the cyclones.

Presently no metallic materials practically or commercially available, are suitable to withstand the high temperatures in the range of 2000° F to 3000° F and higher to which the gas outlet tube is exposed in critical industrial processes.

Ceramic or refractory materials are commercially available to withstand such high temperatures. However, the use of the gas discharge tube made entirely of such materials encounters design, structural and other limitations which makes their use for continuous commercial processes unsuitable. The employment of gas discharge tubes made from metallic materials and insulated on both sides with ceramic or refractory materials is unsuitable since if both sides of the gas discharge tube are exposed to the high temperature the metal is trapped within the insulation materials and is subjected to the high temperature on both sides and will reach the fluid or molten temperature and fail structurally.

By means of the present invention a gas discharge tube structure has been provided whereby commonly available structural materials may be employed in the cyclone separator construction in such a fashion that the gas discharge tube may be made from commonly available metal and insulated on the interior, i.e., the hot side, by conventional refractory materials that are used in the remainder of the interior of the cyclone separator.

In order to prevent a heat build-up in the steel structural portion of the gas discharge tube where it extends below the top of the separator housing a space of annular cross section is provided. This structure is effected by an inverted frusto-conical upwardly diverging steel wall which is connected at the bottom to the bottom portion of the gas outlet tube and at the top to a flat top wall of the cyclone separator. This structure provides a space for the dissipation of heat. Within the space heat transfer fins extend radially between the exterior of the gas outlet tube and the exterior of the upwardly diverging wall and are connected to the top of the separator. They are provided to further facilitate the dissipation of heat in the afore-mentioned space to the cooler atmosphere surrounding the cyclone. These radial fins further provide additional structural strength to provide a rigid connection between the gas outlet tube and the upwardly diverging wall and the top of the cyclone separator.

The number, size, material selection and other characteristics of the heat transfer fins can be designed to maintain the temperature of the metal portion of the gas discharge tubes at levels at which the metal materials will have a long and acceptable life. Thus the instant invention solves a major problem in the design of cyclone separator equipment for use in high temperature processes where failure of metallic materials at such high temperatures is a problem.

The above features are objects of this invention and further objects will appear in the detailed description which follows and will otherwise be apparent to those skilled in the art.

For the purpose of illustration of this invention there is shown in the accompanying drawings a preferred embodiment thereof. It is to be understood that these drawings are for the purpose of example only and that the invention is not limited thereto.

IN THE DRAWINGS

DESCRIPTION OF THE INVENTION

Figure 1:
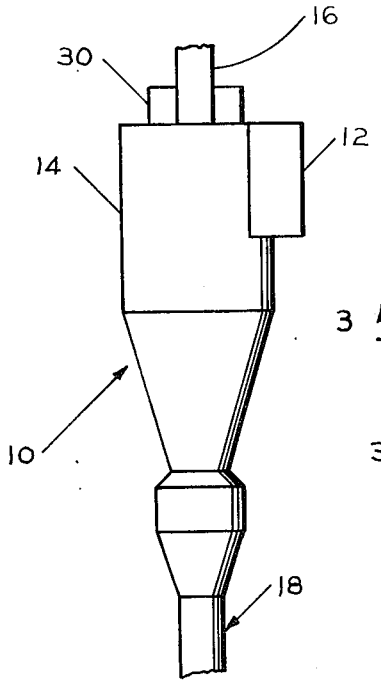
FIG. 1, is a view in front elevation of the cyclone separator of this invention.

The cyclone separator of this invention is generally referred to by the reference numeral 10 in FIG. 1. It is comprised of gas inlet 12, a separator housing or body 14 and a gas discharge outlet 16. A solids outlet 18 extends from the bottom of the cyclone separator downwardly.

Figure 3:
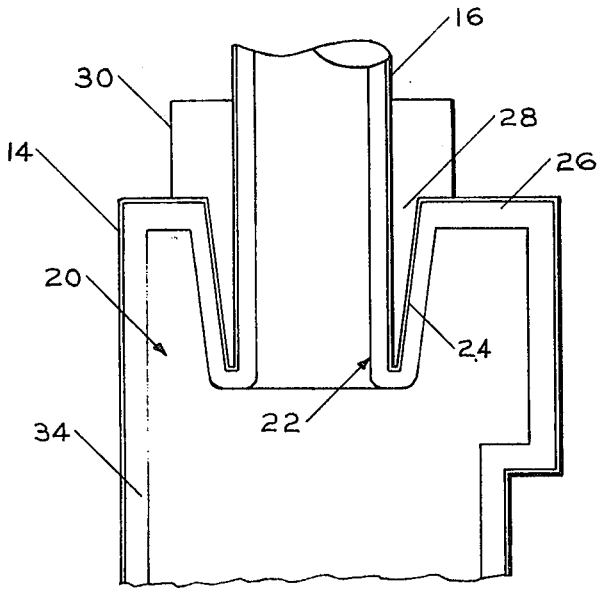
FIG. 3, is a view in cross section taken on the line 3—3 of FIG. 2.

The cyclone separator housing is of generally conventional construction at the side and bottom portion. Thus the gas inlet 12 which is used for the introduction of hot gases laden with solid particle enters generally tangentially at the top of the cyclone body. The gas discharge tube 16 as best shown in FIG. 3 extends from a generally designated vortex portion 20 at the top of the housing and below the top of the shell upwardly for collection of gases and distribution as desired. A bottom portion 22 of the gas outlet tube extends downwardly generally to the bottom portion of the gas inlet 12 as best appears in FIG. 3. The lower end of the bottom portion 22 of the gas outlet tube is connected to an upwardly diverging frusto-conical wall 24 which extends up to the top portion 26 of the housing. This wall when connected to the flat top wall 26 of the cyclone separator provides an annular space 28 between exterior of the bottom portion 22 of the gas outlet tube and ensures that the gas outlet tube exterior wall does not contact any hot gases. This annular space 28 is employed for heat dissipation.

Figure 2:
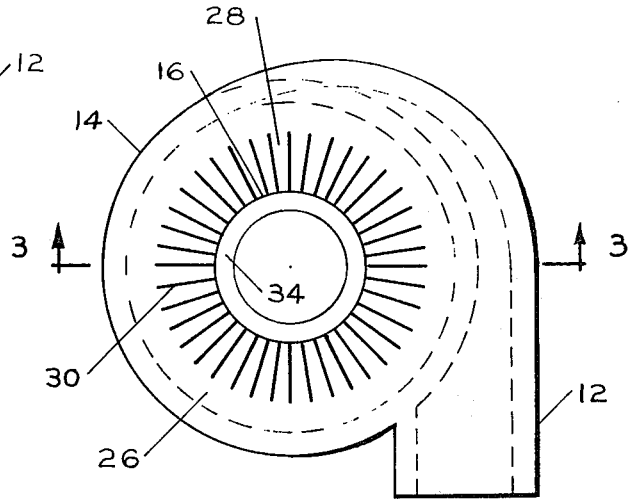
FIG. 2, is an enlarged top plan view of the cyclone separator.

Radial fins 30 shown in FIGS. 2 and 3 extend between and are connected to the exterior surface of the upwardly diverging frusto-conical wall 24 and the top wall 26 of the separator shell. Either one of the latter connections which may be by weldments or other conventional connecting means that provide heat transfer between the walls and the fins may be omitted since only one such type of connection is needed to rigidly connect the fins to the tubular outlet and the top portion of the shell. These radial fins are constructed of metallic material for rapid heat dissipation and strength and extend upwardly above the top of the cyclone separator housing as best shown in FIG. 3. This construction not only provides for additional heat dissipation to the atmosphere but also provides a strong rigid structure connecting the exterior surface of the gas outlet tube to the top of the separator housing and the upwardly diverging wall structure.

The interior of the cyclone separator is insulated with a lining of conventional refractory or ceramic material as indicated at reference numeral 34. This refractory material extends along the interior walls of the top of the housing as shown in the upwardly frusto-conical wall and the interior of the gas outlet tube to minimize the heat transfer from the hot gases to the metallic walls of the cyclone separator and the upwardly diverging wall in the gas outlet tube.

In use the cyclone separator functions in the same general fashion as a conventional cyclone separator. Hot gases are introduced through the inlet 12 and circulate in the vortex 20 at the top portion of the cyclone separator around the gas outlet tube which acts as a conventional vortex finder. As the hot gases circulate solids move downwardly and are separated. The hot, solid free gases pass upwardly through the outlet tube 16 for distribution as desired.

Thus through the instant invention a cyclone separator has been provided which acts as a conventional cyclone but has greatly improved heat dissipation properties through provision of the structure providing the annular heat dissipating pocket or space 28. The additional heat dissipation and stability provided by the radial fins further improves the heat dissipation and strength of the gas outlet structure at the top of the separator housing and minimizes the metallic failure of the outlet gas tube structure at high temperatures.

Various change and modifications may be made within this invention as will readily be apparent to those skilled in the art. Such changes and modifications are within the scope and teaching of this invention as defined by the claims appended hereto.

I claim:

1. A cyclone separator having a housing comprised of a metallic exterior separator shell and interior wall insulating means, said separator shell having a generally cylindrical top portion provided with a horizontally tangentially extending gas inlet, a gas outlet at the top of the separator shell comprising a vertically extending metallic tubular member, said tubular member having a lower portion extending into the top portion of the separator shell, said lower portion of the tubular member being connected at its bottom to an inverted frusto-conical upwardly diverging wall, said diverging wall forming part of the top portion of the separator shell to provide a heat dissipating air space between the lower portion of said tubular member and said diverging wall, the insulating means comprising an insulating layer on the interior of the separator shell covering at least the top portion of the shell and the interior wall of the tubular member and said diverging wall.

2. The cyclone separator of claim 1, in which heat dissipating radial fins are provided connecting an exterior surface of the tubular outlet member with an exterior surface of the upwardly diverging wall forming part of the top portion of the separator shell, said fins rigidly connecting said tubular member to the diverging wall to strengthen the structure.

3. The cyclone separator of claim 2, in which the fins are metallic and extend vertically at their bottom from a juncture of the bottom of the tubular outlet with the diverging wall to above the top of the separator shell.

4. The cyclone separator of claim 1, in which the tubular member extends downwardly through the center of the top wall to substantially the same level as the gas inlet to provide a central area about which the inlet gas circulates, said upwardly diverging wall forming a baffle to protect the exterior wall of the tubular gas outlet member from contact with the gas.

5. The cyclone separator of claim 1, in which heat dissipating fins are provided in said heat dissipating air space.

6. The cyclone separator of claim 5, in which said fins extend from an exterior surface of the tubular outlet member to an exterior surface of the upwardly diverging wall and further extend above the top portion of the separator shell.

7. The cyclone separator of claim 6, in which said fins are rigidly connected to the exterior surface of the tubular outlet member and the exterior surface of the top portion of the separator shell to strengthen the structure.

8. A cyclone separator having a housing comprised of a metallic exterior separator shell and interior wall insulating means, said separator shell having a generally cylindrical top portion provided with a horizontally tangentially extending gas inlet, a gas outlet at the top of the separator shell comprising a vertically extending metallic tubular member, said tubular member having a lower portion extending into the top portion of the separator shell, said lower portion of the tubular member being connected at its bottom to an inverted frusto-conical upwardly diverging wall, said diverging wall forming part of the top portion of the separator shell to provide a heat dissipating air space between the lower portion of said tubular member and said diverging wall and heat dissipating radial fins being provided connecting an exterior surface of the tubular outlet member with an exterior surface of the upwardly diverging wall forming part of the top portion of the separator shell, said fins rigidly connecting said tubular member to the diverging wall to strengthen the structure, and the wall insulating means comprises an insulating layer covering at least the connection of the lower portion of the tubular member to the upwardly diverging wall.

9. The cyclone separator of claim 8, in which the fins are metallic and extend vertically at their bottom from a juncture of the bottom of the tubular outlet with the diverging wall to above the top of the separator shell.

* * * * *